US006427708B1

(12) United States Patent
Jermyn

(10) Patent No.: US 6,427,708 B1
(45) Date of Patent: Aug. 6, 2002

(54) DEVICE FOR VISUALLY INDICATING THE STATUS OF THE WASHING CYCLE OF A DISHWASHER WITH OPENING OF THE DOOR THEREOF

(76) Inventor: Arthur C. Jermyn, 15914 Overview Rd., Poway, CA (US) 92064

( * ) Notice: Subject to any disclaimer, the term of this patent is extended or adjusted under 35 U.S.C. 154(b) by 0 days.

(21) Appl. No.: 09/855,631

(22) Filed: May 15, 2001

(51) Int. Cl.[7] ..... A47L 15/42
(52) U.S. Cl. ..... 134/113; 116/216
(58) Field of Search ..... 134/113; 116/216, 116/217; 374/160

(56) References Cited

U.S. PATENT DOCUMENTS 3,608,514 A * 9/1971 Dunn
4,129,954 A * 12/1978 Hulteen
4,353,990 A * 10/1982 Manske et al.
5,229,753 A * 7/1993 Berg et al.
D345,829 S * 4/1994 Mancuso et al.
5,467,545 A * 11/1995 Zillner
5,477,872 A * 12/1995 Berg
5,839,458 A * 11/1998 Delcarson
6,196,239 B1 * 3/2001 Esky

* cited by examiner

*Primary Examiner*—Frankie L. Stinson

(57) ABSTRACT

The invention relates to a visual monitoring device for use in conjunction with a dishwasher wherein a buoyant and weighted member is maintained in a cup-shaped receptacle and movable by water accumulated in the receptacle during the washing portion of the operating cycle, thereby changing the position of the buoyant member to indicate whether additional items can be accepted for washing.

8 Claims, 1 Drawing Sheet

DEVICE FOR VISUALLY INDICATING THE STATUS OF THE WASHING CYCLE OF A DISHWASHER WITH OPENING OF THE DOOR THEREOF

FIELD OF THE INVENTION

The invention relates to a monitoring device for use in conjunction with a dishwasher and the operating cycle therefore to ascertain the status of the washing portion of the operating cycle when the door is opened for placing additional items in the dishwasher rack.

DESCRIPTION OF THE ART

In the operation of the usual homestyle type of dishwasher the dishes are loaded into a rack slidably mounted in the washer and extendable for loading when the dishwasher door is opened, the operating cycle usually being initiated with closing of the door. However, there are many instances in which the dishwasher may only be partially loaded and the door closed and then, at some later time, additional dishes may want to be added to the rack before the operating cycle is actually started. In some instances, some sort of an indicator may be associated with the operating cycle to indicate when the dishwashing cycle is completed. However, opening the dishwasher door after the cycle has been completed renders the cycle inoperative, so for the addition of only one or a few more dishes, the cycle must be fully operative. Further, at some earlier time, if the operation of the dishwasher has been commenced and additional dishes may want to be washed in the same cycle, then it may be too late to actually insert the dishes because the washing portion of the cycle has already been completed. It is therefore of help to know if the washing portion of the cycle has not yet been started or has been partially completed, or if the full cycle has been completed so that a decision can be made relative to the status of the washing time that may be left to complete the washing of any dishes to be added. A problem also arises in the event the user intends to remove only one or more dishes from the dishwasher during the operation of the cycle, although a signal may be given upon completion of the operating cycle, this signal is then negated as soon as the door of the dishwasher is opened, even to remove only one dish. This does not tell the user, when there are subsequent openings of the door, whether or not the dishes have been completely washed particularly with reference to the washing portion of the cycle. With the present invention, this device reveals with the opening of the door if the washing cycle has been started, has been partially completed, or has been completed in its entirety, thereby negating any further use of the washing portion of the cycle for washing additional dishes. In other words, the device eliminates any guesswork on the part of the user as to the portion of the operating cycle that may stir be of use.

SUMMARY OF THE INVENTION

The present invention is concerned primarily with a visual monitoring device that is completely independent of the operating cycle for the dishwasher, thereby eliminating any guesswork as to the status of the operating cycle. In other words, the cycle of operation normally consists of washing, rinsing and drying. It may be advantageous to know exactly when one or more additional dishes may be added to the washer once the operating cycle has been initiated. Actually, it is of no benefit to place additional dishes in the washer if the washing portion of the cycle has already been completed. It is to this end that the invention is directed. As will be described hereinafter, it will be evident that such a device is relatively simple, not only in its makeup, but also in the way it may be used and can be set to operate on its own with no connection to the actual electrical circuitry of the operating cycle.

The primary object of the invention, therefore, is to provide a visual monitoring device for use in conjunction with a dishwasher for ascertaining partial and complete operation of the washing portion of the operating cycle with the opening of the dishwasher door at any stage of the cycle.

A further object of the invention is to provide a visual monitoring device which embodies a buoyant member carrying an indicating means for displaying the condition of the washing portion of the operating cycle of the dishwasher at any time with the opening of the dishwasher door.

Another object of the invention is to provide a device which is completely independent of the operating cycle of the dishwasher for monitoring the washing portion of the operating cycle.

Yet another object of the invention is to provide a device easily mountable on the rack of the dishwasher and which can be selectively positioned in a position for controlling the flow of water accumulated in the device during the washing portion of the operating cycle and then showing completion of the washing portion of the operating cycle by means of a buoyant member associated with water accumulated during the washing portion of the cycle.

These and other objects and advantages of the invention will be apparent to those skilled in the art by the description which follows.

DESCRIPTION OF THE DRAWING

Reference is now made to the accompanying drawing wherein like reference numerals and characters designate like parts and wherein.

DESCRIPTION OF PREFERRED EMBODIMENTS

Figure 1:
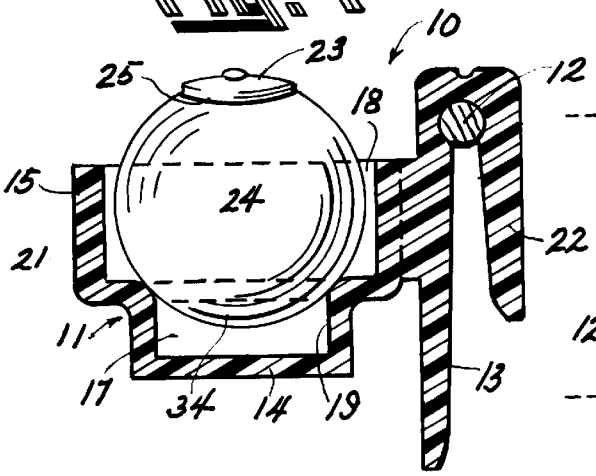
FIG. 1 is a vertical section through the device showing a weighted buoyant member in position for closing the first chamber of the receptacle.
Figure 2:
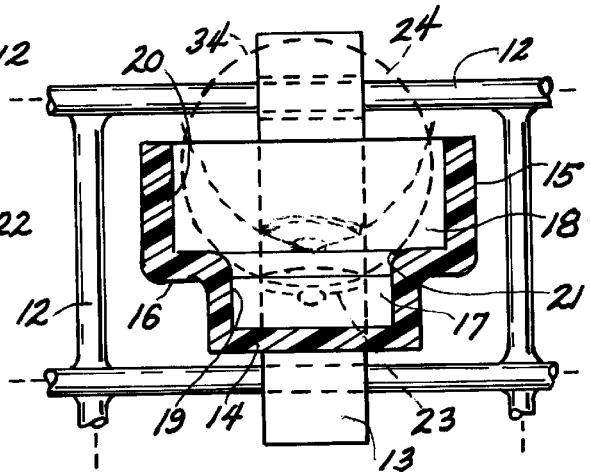
FIG. 2 is a vertical section through a cup shaped receptacle showing the manner in which the buoyant monitoring device is mounted on the rack so as to be responsive to water used to wash the dishes during the washing portion of the operating cycle for indicating the status of the cycle when the dishwasher door is opened.

The monitoring device 10 comprises a receptacle 11 which is clamped or hooked on the rack 12 of a dishwasher by means of the clamping extension 13, as shown more clearly in FIGS. 1 and 2. The receptacle 11 comprises a bottom wall 14 and has an extending side wall 15 which at a junction 16 divides the receptacle into a first chamber 17 and a second chamber 18. The chambers 17 and 18 are coextensive with one another having a cylindrical shape, the first chamber 17 having an inner diameter 19 that is of smaller size than the inner diameter 20 of the second chamber 18. At the junction 16 the side wall 15 extends inwardly and forms a shelf 21 that may be considered to be integral with the wall 15 per se and also which provides for the first and second chambers 17 and 18 to be coextensive. The clamping means 22, as shown in FIG. 1, can be formed integral with the side wall of the second chamber 18.

The weighting means 23 is secured to a peripheral surface of a buoyant member 24 to provide a dual function in the operation of the device. Again, as shown in FIG. 1 particularly, the weighting means 23 serves to hold the buoyant monitoring means 24 in position on the shelf 21 to close the first chamber 17, thereby serving in effect as a floating valve member.

The weighting means 23 comprises a metal disc 25 that is fastened to the peripheral surface of the weighting means 23 by means of a screw or a suitable water-proof adhesive. The weight of the disc 25 must be sufficient to provide a rolling action of the ball 34 so upon floating freely in water will present its diametrically opposed surfaces to interchange as set forth hereinafter.

Figure 3:
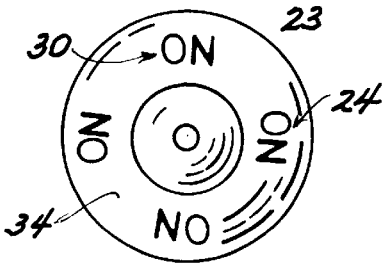
FIGS. 3 and 4 are views of a buoyant and weighted member selectively positionable in the receptacle with the showing of the weighting means and indicating means that are on diametrically opposed peripheral surfaces of the buoyant member.
Figure 4:
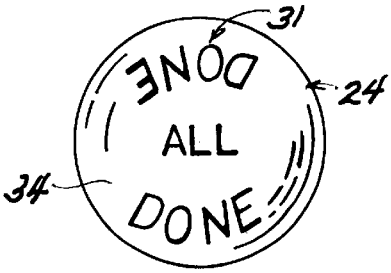
Figure 5:
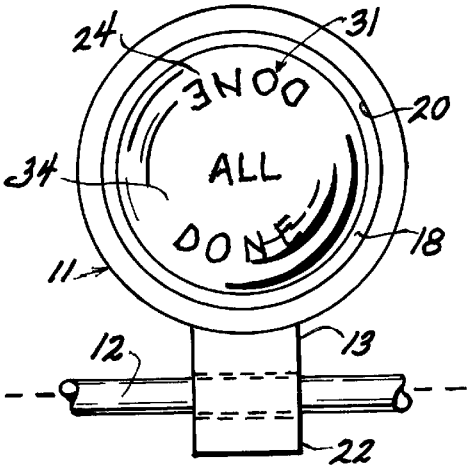
FIG. 5 is a top view showing the relation of the receptacle and buoyant member to a portion of the dishholding rack.
Figure 6:
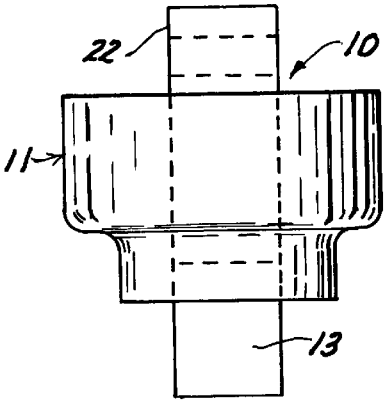
FIG. 6 is an elevational view of the receptacle member per se.

With reference to FIGS. 3 and 4, it will be noted that in FIG. 3, which is in effect a plan view of the buoyant monitoring means 24 as shown in FIG. 1, a first designating means 30 is provided on the peripheral surface thereof in association with the weighting means 23. The second designating means 31 is provided on a diametrically opposed area of a peripheral surface of the buoyant monitoring means 24. Accordingly, the buoyant monitoring means 24 can be selectively positioned manually, or as described hereinafter, maintained in a floating relation and position by the weighting means 23 relative to the inner diameter 19 and the shelf 21.

The buoyant spherical monitoring means 24 comprises a hollow plastic ball 34 with weighting means 23 attached thereto in an area on its peripheral surface. The buoyant means 24, while shown in this particular instance as the plastic ball 34, can be of any material that is fairly light in weight and does not necessarily need to be plastic, but can be of a material such as foam plastic or foam rubber. Again, depending on the size and requirements of the dishwasher per se, even a wood member that is spherical in shape but of a light wood, such as balsa, can also be used.

The ball 34 carries a first indicating means designated by the numeral 31 on a portion of its peripheral surface for visually showing to the user that the operating cycle is inoperative, that is, has not been rendered operative, or has been partially or fully completed with opening of the washer door. At another portion of the peripheral surface of the ball 34 and diametrically opposed to the first indicating means 30 is a second indicating means 31 that indicates the washing portion or all of the operating cycle has been completed. The ball 34 is selectively positioned when the door is first opened within the second chamber and in peripheral engagement with the shelf 21 to close the first chamber 17 and thereby visually displaying to the user via the first indicating means 30 that additional dishes can be added to the rack.

The weighting means 23 associated with the buoyant monitoring means 24 maintains a ball 34 in engagement with the shelf 21 until the dishwasher has been closed and the operating cycle has started. At this point, which is the start of the washing portion of the cycle, water will gradually accumulate in the second chamber 18 and when sufficient water has accumulated will cause the ball 34 to rise into a position free of the shelf 21. When sufficient water has accumulated in the chamber 18, not only will the ball 34 float upward and in a direction away from the shelf 21 but will permit the accumulated water to flow into the first chamber 17 as the washing portion of the operating cycle continues, more water will be picked up by the second chamber 18 but the weighting means 23 will prevent the ball from reseating in its initial position because floating free of shelf 21 the ball will turn, due to weighting means 23 into a diametrically opposed position relative to its original position and the shelf 21. The amount of water in the first chamber 17 plus what is in the second chamber 18 due to ball 34 will hold the ball in position so that cannot be returned to the shelf 21 while the level of water maintains the second chamber 18 in a practically fill condition. When the ball 34 rotates 180 degrees to position the weighting means 23 over and spaced from shelf 21 both indicating means 30 and 31 on the ball 34 will also move therewith so the second indicating means 31 will be visually presented when the washer door is again opened, not necessarily at the time of completion of the washing portion of the operating cycle but at any point in the operating cycle when the door is opened. In this way, the user can always be aware of the condition of the washing portion of the operating cycle so that proper placement of additional items in the rack can be accomplished at the right time to ensure proper washing for all or at least a part of the washing portion of the operating cycle. As set forth and described hereinabove it can be readily appreciated by anyone skilled in the art that the invention disclosed herein provides a novel way of achieving a result that is not dependent on the circuitry of the operating cycle. It should be pointed out at this point that in addition to the ball 34 being made of various types of material, that a relationship between the first and second chambers 17 and 18 to obtain the floating action can be and should be of such a nature that release of the water first accumulated in the second chamber 18 occurs in some proper timed relation to the completion of the washing portion. Consequently it has been found that if a volume ratio is found between the first chamber 17 and the second chamber 18 of about 1:3, that the resulting action due to the water accumulated and flowing from one chamber provides adequate movement of the ball 34 and is sufficient to maintain the ball 34 with the weigh of the weighting means 23 directed towards the shelf 19 in such a relation that there is a flow between the two chambers and at the same time allowing the weighting means 23 to hold the ball 34 in proper position with respect to the second indicating means 31 so as to place it in visual relationship to the door when it is opened. Hence, there are differences in material used for the buoyant monitoring member 24 and the relation of volume size between the first and second chambers 17 and 18 that can be effective without altering the operational function or the purpose of the invention as described and disclosed hereinabove.

Accordingly, the invention has been described in detail with particular reference to preferred embodiments thereof but it will be understood that variations and modifications can be effective within the spirit of the invention.

I claim:

1. A visual monitoring device for use in conjunction with a dishwasher comprising a cabinet having a door, at least one dish rack and an automatic operating cycle controlled by the opening and closing of the door for washing, rinsing and drying the dishes positioned in the rack to ascertain partial and complete operation of the washing portion of the cycle with opening of the door at any stage of the cycle, comprising in combination:

a cup-shaped receptacle having a bottom wall with a side wall extending vertically therefrom to form a first generally cylindrical chamber with an inner diameter and a second generally cylindrical chamber having an inner diameter larger than that of the first chamber and coextensive therewith from a junction intermediate the chambers to provide a shelf with an opening common to both chambers and commensurate with the inner diameter of the first chamber;

means integral with the outer surface of the second chamber for clamping the receptacle to the rack in a position relative to and within the rack in proximity to the dishes;

a buoyant spherical monitoring member having a first means associated therewith on a peripheral surface area thereof for indicating the operating cycle is inoperative and a second means associated therewith on a peripheral surface area diametrically opposed to that of the first mentioned peripheral surface area for indicating that at least the washing portion of the operating cycle has been completed, the buoyant member being selectively positionable when the door is first opened, within the second chamber in peripheral engagement with the shelf to close the common opening and visually displaying the first indicating means; and means associated with the buoyant member for weighting and maintaining the same in the shelf engaging position until sufficient water has accumulated in the second chamber during the washing portion of the operating cycle for floating the buoyant member into the second chamber free of the shelf to permit the water accumulated in the second chamber to flow into the first chamber and additional water to accumulate in the second chamber whereby the buoyant member is maintained in a position disengaged from the shelf to turn and display the second indicating means to indicate completion of the washing portion of the cycle upon reopening of the door and at any other stage of the cycle.

2. A visual monitoring device in accordance with claim 1 wherein the cup member and the clamping means are integrally formed to provide a unitary structure.

3. A visual monitoring device in accordance with claim 1 wherein the buoyant member is a hollow plastic ball having a diameter intermediate to that of the first and second chambers.

4. A visual monitoring device in accordance with claim 1 wherein the buoyant member is spherical and is of a foam type moldable material.

5. A visual monitoring device in accordance with claim 1 wherein the volume of the second chamber is at least three times that of the first chamber.

6. A visual monitoring device in accordance with claim 1 wherein the diameter of the spherical buoyant member is larger than the diameter of the common opening and smaller than the inner diameter of the second chamber.

7. A visual monitoring device in accordance with claim 1 wherein the first and second indicating means on the peripheral surface of the buoyant member are color coded for visual reading.

8. A visual monitoring device in accordance with claim 1 wherein the weighting means is secured to the peripheral surface of the buoyant member within the area of the first indicating means and is sufficient to maintain the buoyant member free of the common opening and within the second chamber to display the second indicating means upon opening the door during any stage of the operating cycle.

* * * * *